US006105777A

United States Patent [19]

Castellarin et al.

[11] Patent Number: 6,105,777

[45] Date of Patent: Aug. 22, 2000

[54] PROTECTING THE OUTER SURFACE OF CYLINDERS FOR CONTAINING FLUID

[76] Inventors: Sandro J. Castellarin, 24-6859 Edenwood Drive, Mississauga, Ontario, Canada, L5N 5Z8; Mark H. Tweedle, 82 Glenashton Drive, Oakville, Ontario, Canada, L6H 6G2

[21] Appl. No.: 09/258,888

[22] Filed: Mar. 1, 1999

[51] Int. Cl.[7] ..... B65D 65/00

[52] U.S. Cl. ..... 206/497; 206/459.5

[58] Field of Search ..... 206/497, 459.5, 206/320, 446, 438; 53/427

[56] References Cited

U.S. PATENT DOCUMENTS

| | | | |
|---|---|---|---|
| 2,404,513 | 7/1946 | McCabe | 206/446 |
| 2,814,382 | 11/1957 | Lassiter | 206/497 |
| 2,996,180 | 8/1961 | Bruce | 206/497 |
| 3,764,002 | 10/1973 | Spiegel et al. | 206/493 |
| 4,205,750 | 6/1980 | Dews | 206/534 |
| 4,377,234 | 3/1983 | Kaplan | 206/497 |
| 4,815,603 | 3/1989 | Harris | 206/497 |
| 5,050,738 | 9/1991 | McAdams | 206/497 |
| 5,257,704 | 11/1993 | Gutt | 215/246 |
| 5,489,126 | 2/1996 | Gray, Jr. | 206/493 |
| 5,667,071 | 9/1997 | Nakagoshi et al. | 206/455 |
| 5,862,911 | 1/1999 | Phillips, II et al. | 206/320 |

*Primary Examiner*—Paul T. Sewell
*Assistant Examiner*—Nhan T. Lam
*Attorney, Agent, or Firm*—Robert F. Delbridge

[57] ABSTRACT

A method of protecting the outer surface of a cylinder for containing fluid. The method includes the steps of providing a cylinder for containing fluid, providing a heat shrinkable polymer sleeve, fitting the polymer sleeve around the cylinder, and applying heat to the sleeve to heat-shrink the sleeve into engagement with an outer surface of the cylinder. The invention also provides a polymer sleeve used in the method and a cylinder assembly resulting from the method.

22 Claims, 3 Drawing Sheets

PROTECTING THE OUTER SURFACE OF CYLINDERS FOR CONTAINING FLUID

FIELD OF THE INVENTION

The present invention relates to cylinders for containing fluid, and more particularly to a method of protecting the outer surface of such cylinders.

BACKGROUND OF THE INVENTION

Fluid-filled cylinders are used in various industries such as the medical, pharmaceutical and chemical industries for containing fluid in the form of gas or liquid under compression. These cylinders can be designed for one-time use or for re-use. The present invention is concerned primarily with refillable and reusable cylinders.

Known refillable cylinders are commonly made of metal, such as steel or aluminium, and painted either for cosmetic reasons or to comply with industry norms for identification of the fluid contents. For example, in Canada, oxygen-containing cylinders are painted a standard white colour, while in the United States they are painted a standard green colour. Other product information, some of which is mandatory, is printed on labels affixed to the cylinders.

When these cylinders are emptied, they can either be refilled with the same substance or a different substance altogether. In the case of the latter, relabelling is required and it may be necessary to paint the cylinders a different colour to indicate the new substance.

When refilled with the same substance, no repainting or relabelling is required. However, over time and with handling, there is a tendency for the paints and labels to peel off or exhibit other wear characteristics such as scratches and fading. Further, metal cylinders may rust due to exposure to the elements. For many cylinder companies which sell fluid-filled cylinders and refill emptied cylinders, the look of the cylinder is an important feature of the product. Consequently, many cylinder companies have adopted a policy of repainting and relabelling emptied cylinders every time they are returned by customers for re-filling. The associated costs of cylinder maintenance are therefore quite substantial.

An object of the invention is therefore to provide a new and improved method of protecting the outer surface of cylinders for containing fluids against wear and exposure in order to maintain their aesthetic appeal while reducing maintenance costs.

SUMMARY OF THE INVENTION

In accordance with a first aspect, the invention provides a cylinder assembly including a cylinder for containing fluid and a heat shrinkable polymer sleeve fitted around the cylinder and heat shrunk into engagement with an outer surface of the cylinder thereby protecting the outer surface.

In accordance with a second aspect, the invention provides a method of protecting the outer surface of a cylinder for containing fluid. The method includes the steps of (a) providing a cylinder for containing fluid;

(b) providing a heat shrinkable polymer sleeve;

(c) fitting the polymer sleeve around the cylinder; and (d) applying heat to the sleeve to heat-shrink the sleeve into engagement with an outer surface of the cylinder thereby protecting the outer surface.

In accordance with a third aspect, the invention provides a heat-shrinkable polymer sleeve for use in the method.

The sleeve may be made of a material selected from the group consisting of polyvinylchloride, polytetrafluoroethylene, fluorinated ethylene propylene, perfluoralkoxy, and ethylene tetrafluoroethylene.

Further, the sleeve may have a shrink ratio with respect to the diameter thereof of from about 1.25:1 to about 4:1 and a thickness of from about 4 mil (101.6 $\mu$m) to about 12 mil (304.8 $\mu$m).

The sleeve may be transparent to reveal the colour of a painted cylinder and any label affixed thereto. In this case, the sleeve protects the paint and label from wear and exposure and the need to repaint and relabel is minimized, if not eliminated. Alternatively, the sleeve may be coloured and/or include printing thereon such that the need for initial painting and/or labelling is reduced or eliminated.

BRIEF DESCRIPTION OF THE DRAWINGS

Preferred embodiments of the invention will now be described with reference to the drawings in which.

DETAILED DESCRIPTION OF THE PREFERRED EMBODIMENTS

Figure 1:
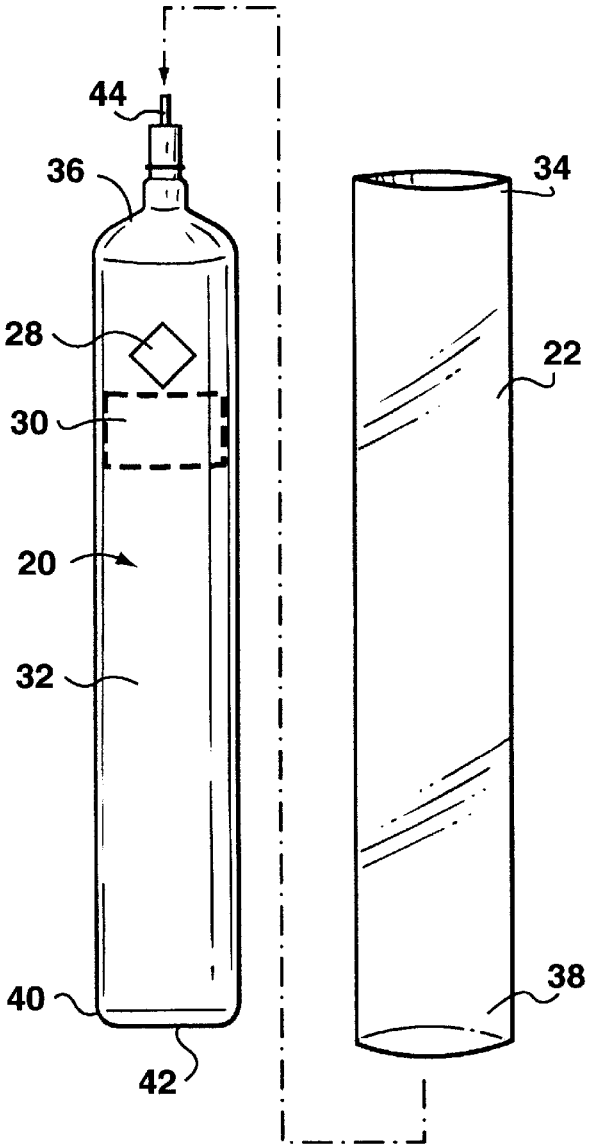
FIG. 1 is a front view of a cylinder for containing fluid and a heat-shrinkable polymer sleeve to be fitted around the cylinder.
Figure 2:
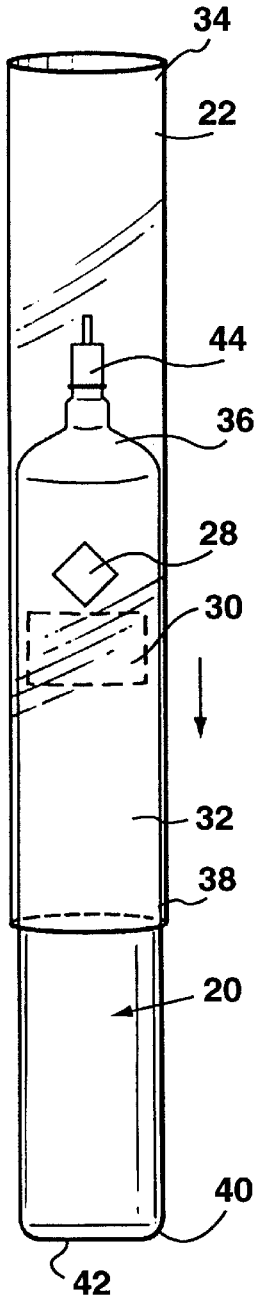
FIG. 2 is a front view of the sleeve being fitted around the cylinder.
Figure 3:
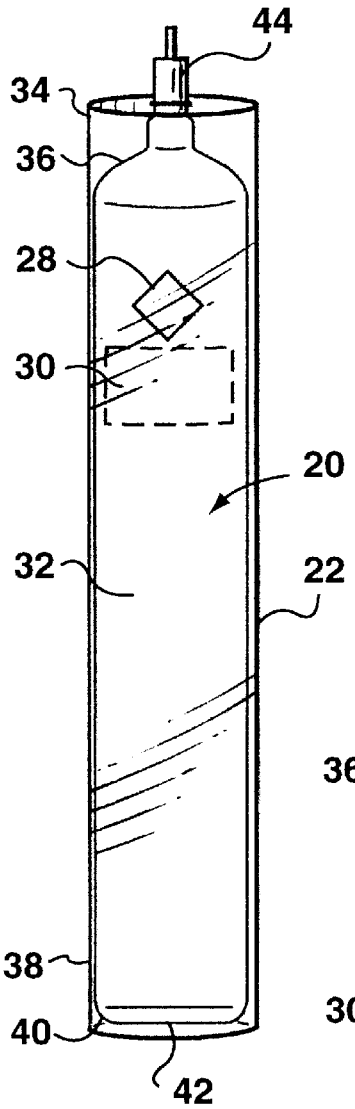
FIG. 3 is a from view of the sleeve fitted around the cylinder.
Figure 4:
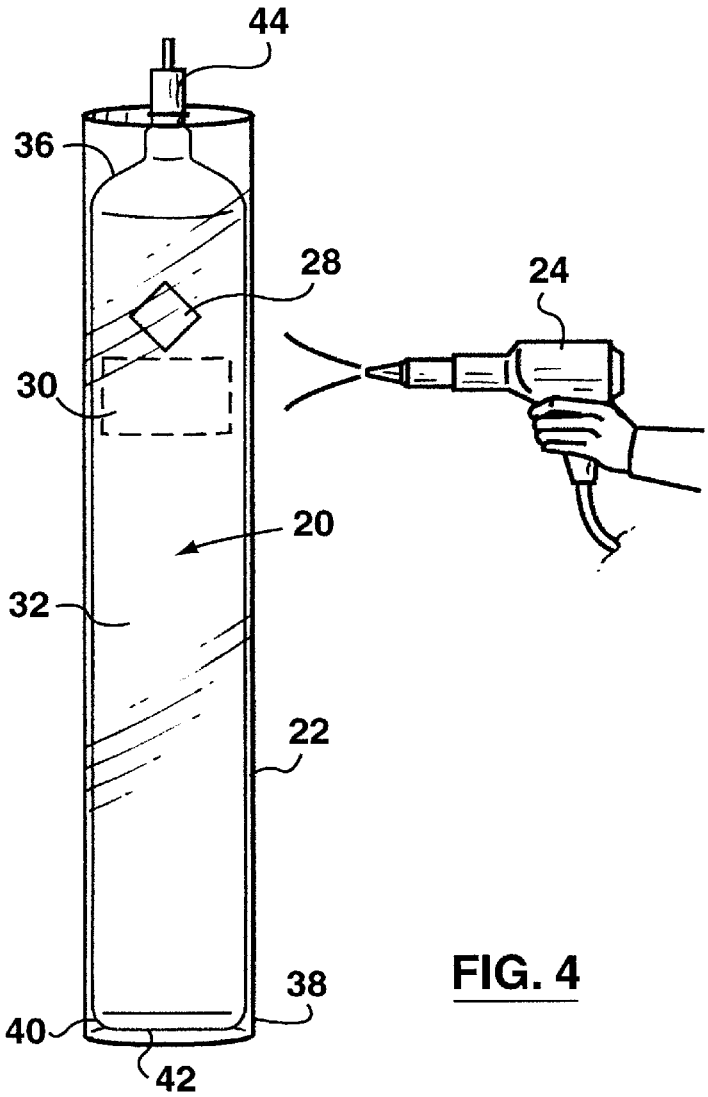
FIG. 4 is a front view showing heat being applied to the sleeve fitted around the cylinder using a manually operable heat gun.
Figure 5:
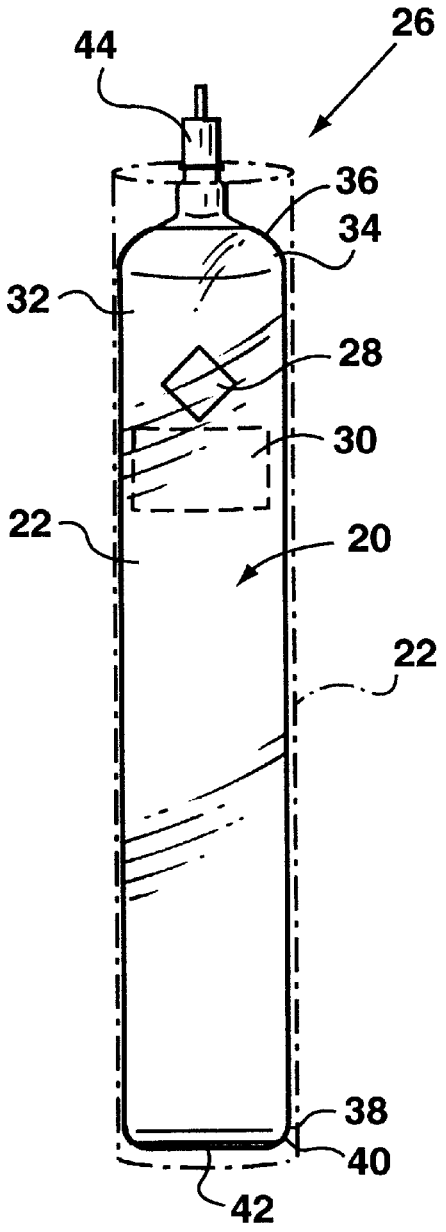
FIG. 5 is a front view showing the sleeve heat shrunk into engagement with an outer surface of the cylinder following the application of heat to form a cylinder assembly.

Referring to FIGS. 1 to 5, the invention provides, in accordance with one of its aspects, a method of protecting the outer surface of a cylinder for containing fluid. The method includes the steps of (a) providing a cylinder for containing fluid designated generally by reference numeral 20 (FIG. 1);

(b) providing a heat shrinkable polymer sleeve 22 (FIG. 1);

(c) fitting the sleeve 22 around the cylinder 20 (FIGS. 2 and 3);

(d) applying heat to the sleeve 22, using a manually operable heat gun 24 in the case of this first preferred embodiment (FIG. 4), to heat shrink the sleeve 22 into engagement with an outer surface of the cylinder 20 thereby protecting the outer surface (FIG. 5).

Referring still to FIG. 5, the invention provides, in accordance with another aspect, a cylinder assembly designated generally by reference numeral 26 which includes the cylinder 20 and the sleeve 22 fitted around the cylinder 20 and heat shrunk into engagement with an outer surface of the cylinder 20 thereby protecting the outer surface.

In this embodiment, the cylinder 20 is a conventional steel gas cylinder 20 which is filled with compressed oxygen. A releasable valve 44 is used to maintain the oxygen in the cylinder 20. The gas cylinder 20 has a body 32 which is painted white to indicate that its contents is oxygen, in accordance with Canadian industry norms. Pre-printed labels 28, 30 containing product information are affixed to the body 32.

The sleeve 22 is transparent, made of polyvinylchloride ("PVC"), and has a thickness of about 8 mil (203.2 μm).

Referring still to FIG. 5, the sleeve 22, prior to heat shrinking, is shown in chain dotted outline. After heat shrinking, the sleeve 22 shrinks both longitudinally, that is, along its length, and diametrically, as can be seen in solid outline. Specifically, the sleeve 22 has a shrink ratio with respect to the diameter thereof of about 2:1 and a shrink ratio with respect to the length thereof of about 1.1:1. The length and diameter of the unshrunk sleeve are selected such that the sleeve 22 may be easily fitted over the cylinder 20 and heat shrunk into engagement with substantially all of the outer surface of the cylinder with a first end portion 34 of the sleeve 22 being heat shrunk into engagement with a tapered shoulder 36 of the cylinder body 32 and a second end portion 38 of the sleeve 22 being heat shrunk into engagement with a curved periphery 40 of a bottom 42 of the cylinder body 32.

The majority of the outer surface of the cylinder body 32 is thus protected against wear and exposure to the elements. Consequently, the need for repainting and relabelling due to wear and exposure is minimized, if not eliminated.

Figure 6:
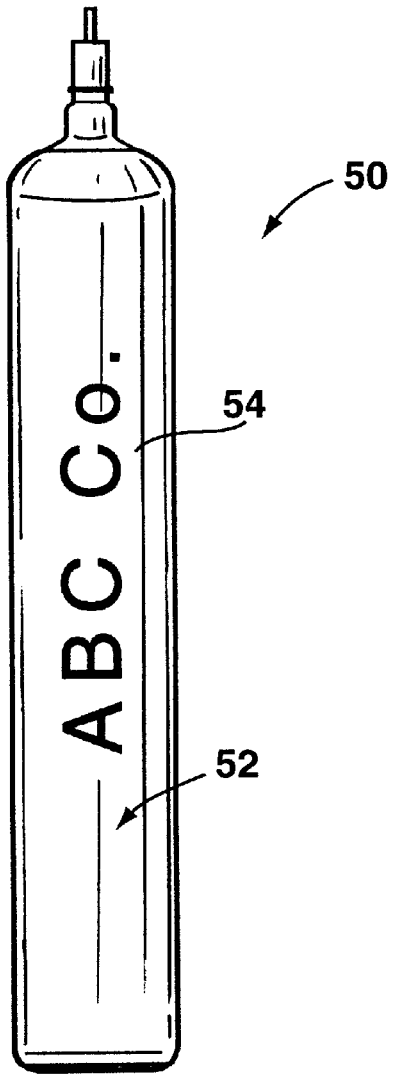
FIG. 6 is a front view of a cylinder assembly according to a second preferred embodiment in which the sleeve is coloured and includes printing thereon.

Referring to FIG. 6, a cylinder assembly according to a second preferred embodiment of the invention, designated generally by reference numeral 50, is shown. The cylinder assembly 50 is similar to the cylinder assembly 26 of the first preferred embodiment in every respect except for the following respects. The cylinder assembly 50 includes an empty unpainted aluminum cylinder designated generally by reference numeral 52 to be filled with oxygen under compression and a heat shrinkable white PVC sleeve 54 fitted around the cylinder and heat shrunk into engagement with an outer surface thereof. The sleeve 54 has printing thereon and consequently the need to affix labels to the cylinder 52 could be eliminated. Further, it is not necessary for the cylinder 52 to be painted initially due to the sleeve 54 being white and providing the desired look of the cylinder assembly 50.

Variations to the aforedescribed embodiments will now be discussed.

It will be appreciated that any other method of heat shrinking as is known in the art may be used in the method of the invention.

The heat shrinkable polymer sleeve may be of any suitable material including polytetrafluoroethylene, fluorinated ethylene propylene, perfluoralkoxy, and ethylene tetrafluoroethylene. Further, the sleeve may have a shrink ratio with respect to the diameter thereof of from about 1.25:1 to about 4:1; and a thickness from about 4 mil (101.6 μm) to about 12 mil (304.8 μm), and more preferably from about 6 mil (152.4 μm) to about 10 mil (254 μm).

The cylinder may be of any size and the dimensions of the sleeve will of course be selected to fit the particular size of the cylinder. For example, cylinders may have heights ranging from about 45 cm to about 150 cm, and diameters in the range of from about 10 cm to about 230 cm. Consequently, the sleeve may have a length within the range of from about 45 cm to about 165 cm, and a diameter within the range of from about 10 cm to about 235 cm, prior to shrinking.

The sleeve may be transparent or translucent and preprinted with information. The sleeve may also be opaque with no printing, in which case labels may be affixed to the outer surface of the sleeve. Further, the sleeve may be one of a selected number of colours, or a combination of different colours.

The sleeve may be of any size and material selected such that, after heat shrinking, the sleeve engages substantially all of the outer surface of the cylinder.

The sleeve may be delivered as individual pre-cut sleeves or in a continuous roll for cutting to user length specifications. Alternatively, the sleeve may be delivered in a continuous perforated roll for easy separation into individual premeasured sleeves.

The foregoing description is by way of example only and is not meant to limit the scope of the invention as defined by the following claims.

What is claimed is:

1. A gas cylinder assembly including a gas cylinder containing gas under pressure and a heat shrinkable polymer protecting sleeve fitted around the cylinder and heat shrunk into engagement with an outer surface of the cylinder; thereby protecting the outer surface, said sleeve having a shrink ratio with respect to the diameter thereof of from about 1.25:1 to about 4:1 and a thickness of from about 4 mil (101.6 μm) to about 12 mil (304.8 μm), said cylinder including a tapered shoulder and said sleeve including a first end position heat shrunk into engagement with said shoulder, said cylinder also including a bottom having a rounded periphery, and said sleeve also including a second end portion heat shrunk into engagement with said rounded periphery, the cylinder having a height within the range of from about 45 cm to about 150 cm, and a diameter within the range of from about 10 cm to about 230 cm, and the sleeve having a length within the range of from about 45 cm to about 165 cm, and a diameter within the range of from about 10 cm to about 235 cm prior to shrinking.

2. A cylinder assembly according to claim 1 in which the sleeve is made of a material selected from the group consisting of polyvinylchloride, polytetrafluoroethylene, fluorinated ethylene propylene, perfluoralkoxy and ethylene tetrafluoroethylene.

3. A cylinder assembly according to claim 2 in which the sleeve is made of polyvinylchloride.

4. A cylinder assembly according to claim 1 in which the sleeve has a shrink ratio with respect to the diameter thereof of about 2:1.

5. A cylinder assembly according to claim 1 in which the sleeve has a thickness of from about 6 mil (152.4 μm) to about 10 mil (254 μm).

6. A cylinder assembly according to claim 5 in which the sleeve has a thickness of about 8 mil (203.2 μm).

7. A cylinder assembly according to claim 1 in which the sleeve is transparent.

8. A cylinder assembly according to claim 1 in which the sleeve is coloured.

9. A cylinder assembly according to claim 1 in which the sleeve includes printing thereon.

10. A cylinder assembly according to claim 1 in which the cylinder is a re-usable compressed fluid cylinder for containing fluid under compression.

11. A cylinder assembly according to claim 1 in which the sleeve is heat shrunk into engagement with substantially all of the outer surface of the cylinder.

12. A method of protecting the outer surface of a gas cylinder for containing gas under pressure the method including the steps of (a) providing a gas cylinder for containing gas with pressure;

(b) providing a heat shrinkable polymer protective sleeve;

(c) fitting the sleeve around the cylinder; and (d) applying heat to the sleeve to heat shrink the sleeve into engagement with an outer surface of the cylinder thereby protecting said outer surface;

said sleeve having a shrink ratio with respect to the diameter thereof of from about 1.25:1 to about 4:1 and a thickness of from about 4 mil (101.6 $\mu$m) to about 12 mil (304.8 $\mu$m), said cylinder including a tapered shoulder and said sleeve including a first end position heat shrunk into engagement with said shoulder, said cylinder also including a bottom having a rounded periphery, and said sleeve also including a second end portion heat shrunk into engagement with said rounded periphery, the cylinder having a height within the range of from about 45 cm to about 150 cm, and a diameter within the range of from about 10 cm to about 230 cm, and the sleeve having a length within the range of from about 45 cm to about 165 cm, and a diameter within the range of from about 10 cm to about 235 cm prior to shrinking.

13. A method according to claim 12 in which the sleeve is made of a material selected from the group consisting of polyvinylchloride, polytetrafluoroethylene, fluorinated ethylene propylene, perfluoralkoxy and ethylene tetrafluoroethylene.

14. A method according to claim 13 in which the sleeve is made of polyvinylchloride.

15. A method according to claim 12 in which the sleeve has a shrink ratio with respect to the diameter thereof of about 2:1.

16. A method according to claim 12 in which the sleeve has a thickness of from about 6 mil (152.4 $\mu$m) to about 10 mil (254 $\mu$m).

17. A method according to claim 16 in which the sleeve has a thickness of about 8 mil (203.2 $\mu$m).

18. A method according to claim 12 in which the sleeve is transparent.

19. A method according to claim 12 in which the sleeve is coloured.

20. A method according to claim 12 in which the sleeve includes printing thereon.

21. A method according to claim 12 in which the cylinder is a re-usable compressed fluid cylinder for containing fluid under compression.

22. A method according to claim 12 in which the sleeve is of a size and material selected such that, in step (d), the sleeve is heat shrunk into engagement with substantially all of the outer surface of the cylinder.

* * * * *